US005835072A

United States Patent [19]

Kanazawa

[11] Patent Number: 5,835,072

[45] Date of Patent: Nov. 10, 1998

[54] DRIVING METHOD FOR PLASMA DISPLAY PERMITTING IMPROVED GRAY-SCALE DISPLAY, AND PLASMA DISPLAY

[75] Inventor: Yoshikazu Kanazawa, Kawasaki, Japan

[73] Assignee: Fujitsu Limited, Kawasaki, Japan

[21] Appl. No.: 598,186

[22] Filed: Mar. 7, 1996

[30] Foreign Application Priority Data

Sep. 13, 1995 [JP] Japan ..... 7-235374

[51] Int. Cl.[6] ..... G09G 3/28

[52] U.S. Cl. ..... 345/60; 345/67; 345/68

[58] Field of Search ..... 345/60, 61, 63, 345/67, 68, 89, 94, 95; 313/585, 581, 586; 315/169.1, 169.4

[56] References Cited

U.S. PATENT DOCUMENTS

| | | | |
|---|---|---|---|
| 3,654,388 | 4/1972 | Slottow et al. . | |
| 3,733,435 | 5/1973 | Chodil et al. | 345/60 |
| 4,002,828 | 1/1977 | Nolan | 345/60 |
| 4,024,529 | 5/1977 | Sakai | 345/67 |
| 5,155,414 | 10/1992 | Sano | 345/60 |
| 5,317,334 | 5/1994 | Sano | 345/148 |
| 5,408,226 | 4/1995 | Kwon | 345/60 |
| 5,489,918 | 2/1996 | Mosier | 345/89 |
| 5,541,618 | 7/1996 | Shinoda | 345/60 |
| 5,583,527 | 12/1996 | Fujisaki et al. | 345/60 |

FOREIGN PATENT DOCUMENTS 0653740 5/1995 European Pat. Off. .

*Primary Examiner*—Jeffery Brier
*Assistant Examiner*—David L. Lewis
*Attorney, Agent, or Firm*—Greer, Burns & Crain, Ltd.

[57] ABSTRACT

A high-definition large-screen panel capable of realizing full-color high-luminance display without the restrictions that have been imposed on luminance (number of sustaining discharges) and gray-scale display or the number of display lines in the past has been disclosed. The panel includes a plurality of cells that selectively discharge to glow. According to a driving method for a plasma display panel, during an addressing period, a voltage is applied selectively to cells according to display data so that a charge proportional to display data can be stored in each cell. During a sustaining discharge period, a sustaining discharge voltage is applied to the plurality of cells so that cells in which given charges are stored can discharge to glow. In the driving method, during the addressing period, a plurality of different voltages associated with gray-scale levels to be displayed are applied to the cells so that a quantity of charge proportional to an applied voltage can be stored in each cell. During the sustaining discharge period, the strength of an applied voltage is varied.

16 Claims, 17 Drawing Sheets

DRIVING METHOD FOR PLASMA DISPLAY PERMITTING IMPROVED GRAY-SCALE DISPLAY, AND PLASMA DISPLAY

BACKGROUND OF THE INVENTION

1. Field of the Invention

The present invention relates to an art for driving a display panel, comprising a set of cells, which is a display device having a memory function. More particularly, this invention is concerned with a driving method for writing display data and performing glowing display through sustaining discharge in an alternating current (hereinafter AC) plasma display panel (PDP) for the purpose of gray-scale display, and with a display for realizing the method.

2. Description of the Related Art

The AC PDP is designed to sustain discharge by applying a voltage alternately to two sustaining electrodes and to thus glow for display. One discharge is completed in one to several microseconds after application of a pulse. Ions that are a positive charge generated by discharge are accumulated on the surface of an insulating layer over one electrode to which a negative voltage is applied. Likewise, electrons that are a negative charge are accumulated on the surface of an insulating layer over another electrode to which a positive voltage is applied.

After a pulse (writing pulse) of a high voltage (writing voltage) is used to induce discharge and produce a wall charge, and when a pulse (sustaining pulse or sustaining discharge pulse) of a lower voltage (sustaining voltage or sustaining discharge voltage) whose polarity is opposite to that of the previous voltage is applied, the previously-accumulated wall charge is duplicated. Consequently, a voltage to be induced in a discharge space increases and eventually exceeds a threshold of a discharge voltage. Discharge then starts. In short, a cell has a feature that once a wall charge is produced by performing one writing discharge, when a sustaining pulse is applied by alternating the polarity, discharging is sustained. This feature is referred to as a memory effect or memory function. In general, the AC type PDP achieves display by utilizing the memory effect.

A PDP cannot vary the intensity of glowing. Luminance is substantially varied by changing the period of glowing, whereby gray-scale display is achieved. Gray-scale display in the PDP is usually achieved by associating each bit of display data with a period of a subfield and varying the length of a subfield according to the degree of weighing each bit. Taking 256-level gray-scale display for instance, display data is composed of eight bits. One frame is displayed for the period of eight subfields. Each bit data is displayed for an associated subfield. The ratio of lengths of subfields is 1:2:4:8:16:32:64:128. One subfield is divided into a reset period, addressing period, and sustaining discharge period. During the reset period, a whole-screen writing pulse is applied to execute self-erasure discharge. All cells in a panel assume a uniform state devoid of a wall charge. During the addressing period, addressing discharge is executed line-sequentially so that a quantity of wall charge permitting sustaining discharge is stored in cells to be allowed to glow. Thus, cells are turned on or off according to display data. Thereafter, sustaining discharge is executed and an image for one subfield is displayed. In this "address sustain period separated sub-field method", luminance is determined with the length of a sustaining discharge period; that is, the number of sustaining pulses. For brighter display, the sustaining discharge period within a frame must be made longer.

As described above, in a known driving method for an AC plasma display panel, the number of displays whose display data can be rewritten during one addressing cycle is one. In a panel having 1000 display lines, 1000 addressing cycles are needed. This poses a problem that when the number of addressing periods is increased for multilevel gray-scale display, a sustaining discharge period cannot be made longer. Thus, luminance (number of sustaining discharges) and gray-scale display, the number of display lines, or a voltage must be traded-off. This impedes full-color high-luminance display in a high-definition large-screen panel.

A subfield method that is employed as a technique for achieving gray-scale display using a plasma display has the foregoing problem of an impediment due to a temporal restriction as well as a problem that since screen glowing during one frame is divided temporally, when an animated image is displayed, the image is seen to be split for each subfield and therefore perceived as unnatural.

SUMMARY OF THE INVENTION

As mentioned above, gray-scale rendering using an existing subfield method has impaired the display quality of a display. An object of the present invention is to solve this problem and to realize full-color high-luminance display using a high-definition large-screen panel.

In order to accomplish the above object, in a plasma display driving method and plasma display in accordance with the present invention, gray-scale display is such that a writing voltage to be applied to each cell is varied according to a gray-scale level, and the glowing intensity is made different according to the writing voltage applied during sustaining discharge.

To be more specific, in the plasma display driving method of the present invention, a plasma display panel comprises a plurality of cells that selectively discharge to glow. During an addressing period, a voltage is applied selectively to the cells according to display data so that a charge proportional to display data can be stored in each cell. During a sustaining discharge period, a sustaining discharge voltage is applied to the plurality of cells so that the cells in which given charges are stored can discharge to glow. Herein, for accomplishing the aforesaid object, during the addressing period, a plurality of different voltages associated with gray-scale levels to be displayed are applied to the cells so that a quantity of charge proportional to the applied voltage can be stored in each cell. During the sustaining discharge period, the strength of the applied voltage is varied.

The plasma display of the present invention has a plurality of cells that selectively discharge to glow, and includes an address circuit for applying a voltage selectively to the cells according to display data so that a charge proportional to display data can be stored in each cell, and a sustain driver for applying a sustaining discharge voltage to the plurality of cells so that cells in which given charges are stored can discharge to glow. Herein, for accomplishing the aforesaid object, the addressing means applies a plurality of different voltages associated with gray-scale levels to be displayed to the cells, and the sustain driver varies the strength of an applied voltage.

During sustaining discharge, the applied voltage is varied so that the cells can selectively glow according to the quantities of wall charge retained therein. In the cells, a period for sustaining discharge is varied in length according to a quantity of wall charge retained. Effective luminance is therefore varied according to a voltage applied during writing.

When the present invention applies to a triple-electrode type plasma display utilizing surface discharge, a plasma display panel includes a plurality of first electrodes and a plurality of second electrodes which are arranged to be parallel to each other, and a plurality of third electrodes arranged orthogonally to the plurality of first electrodes and the plurality of second electrodes. Cells are defined by the first, second, and third electrodes. During an addressing period, a scan pulse is applied successively to the plurality of second electrodes. One display line corresponding to a second electrode to which a scan pulse is applied is selected successively. Application of a voltage corresponding to display data to the plurality of third electrodes constituting one display line during the period during which one display line is selected is repeated for all display lines. During a sustaining discharge period, a voltage whose polarity is reversed cyclically is applied between the plurality of first electrodes and the plurality of second electrodes. In this case, application of a plurality of different voltages associated with gray-scale levels to the cells is realized by applying different a voltage to the plurality of third electrodes according to a gray-scale level represented by display data, or varying a voltage applied to a second electrode during the period during which one display line is selected, and thus varying the timing of applying a voltage to the plurality of third electrodes according to a gray-scale level represented by display data, or by varying a voltage to be applied to a first electrode during the period during which one display line is selected, and thus varying the timing of applying a voltage to the plurality of third electrodes according to a gray-scale level represented by display data. A voltage to be applied to the cells during the addressing period may be able to assume a plurality of voltage levels that are different from one another stepwise like digital data, or may be able to assume continuously different values like analog data.

The present inventor notes that during addressing discharge, that is, a discharge performed to select display cells, a voltage value proportional to a wall charge produced after the discharge ceases differs from another due to the difference of a voltage applied to the electrode, and an applied voltage triggering sustaining discharge is varied according to the difference of a voltage value proportional to a wall charge. For a gray-scale display, therefore, a voltage applied during an addressing period is varied depending on a gray-scale level so that a voltage value proportional to a wall charge will be different; and a sustaining discharge period is then changed in length according to the difference. In other words, a plurality of luminance steps can be displayed by performing one writing; that is, during one subfield.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
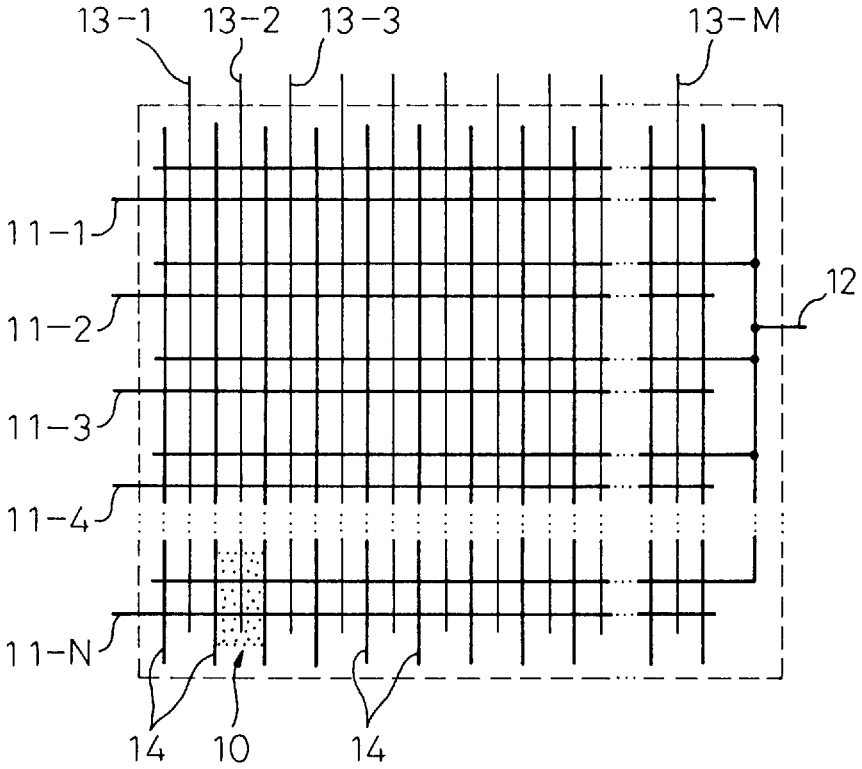
FIG. 1 is a schematic plan view of a triple-electrode surface-discharge type AC PDP.

Before proceeding to a detailed description of the preferred embodiments of the present invention, a prior art plasma display apparatus will be described, with reference to the accompanying drawings relating thereto, for a clearer understanding of the differences between the prior art and the present invention.

AC PDPs are available as a dual-electrode type in which two kinds of electrodes are used to perform selective discharge (addressing discharge) and sustaining discharge and a triple-electrode type in which third electrodes are used to perform addressing discharge. In a color PDP for performing gray-scale display, phosphor formed in discharge cells are excited by infrared rays stemming from discharge. The phosphor has a drawback in that it is susceptible to the impact of ions that are positive charges stemming from discharge. As for the dual-electrode type, having a structure that allows the phosphor to be hit directly by ions, there is a possibility that the service lives of the phosphor are shortened. To avoid this shortening, the color PDP generally adopts the triple-electrode structure based on surface discharge. Moreover, the triple-electrode type is classified into a type in which the third electrodes are formed on a substrate on which the first and second electrodes for performing sustaining discharge are arranged, and a type in which the third electrodes are formed on another substrate opposed to the substrate on which the first and second electrodes are arranged. In addition, the type in which three kinds of electrodes are formed on the same substrate is classified into a type in which the third electrodes are placed on the other two kinds of electrodes for performing sustaining discharge, and a type in which the third electrodes are placed under the two kinds of electrodes. Furthermore, there is a type in which visible light emanating from fluorescent substances is seen through the fluorescent substances (transparent type) and a type in which light reflected from the phosphor is seen (reflection type). The spatial coupling of a cell to be allowed to discharge with an adjoining cell is cut off by a barrier (or rib). The barrier may be placed on four sides in order to enclose a discharge cell so that the discharge cell can be sealed perfectly. Alternatively, the barrier may be placed in one way alone and the coupling between electrodes in the opposite way may be cut off by optimizing the gap (distance) between the electrodes. The present invention can apply to any of the structures. Herein, description will proceed by taking the reflection type for instance. Specifically, a panel has the third electrodes formed on a substrate opposed to another substrate on which electrodes for performing sustaining discharge are formed, barriers are formed only in a vertical direction (that is, orthogonal to the first and second electrodes and parallel to the third electrodes), and some of sustaining electrodes are realized with transparent electrodes.

Figure 2:
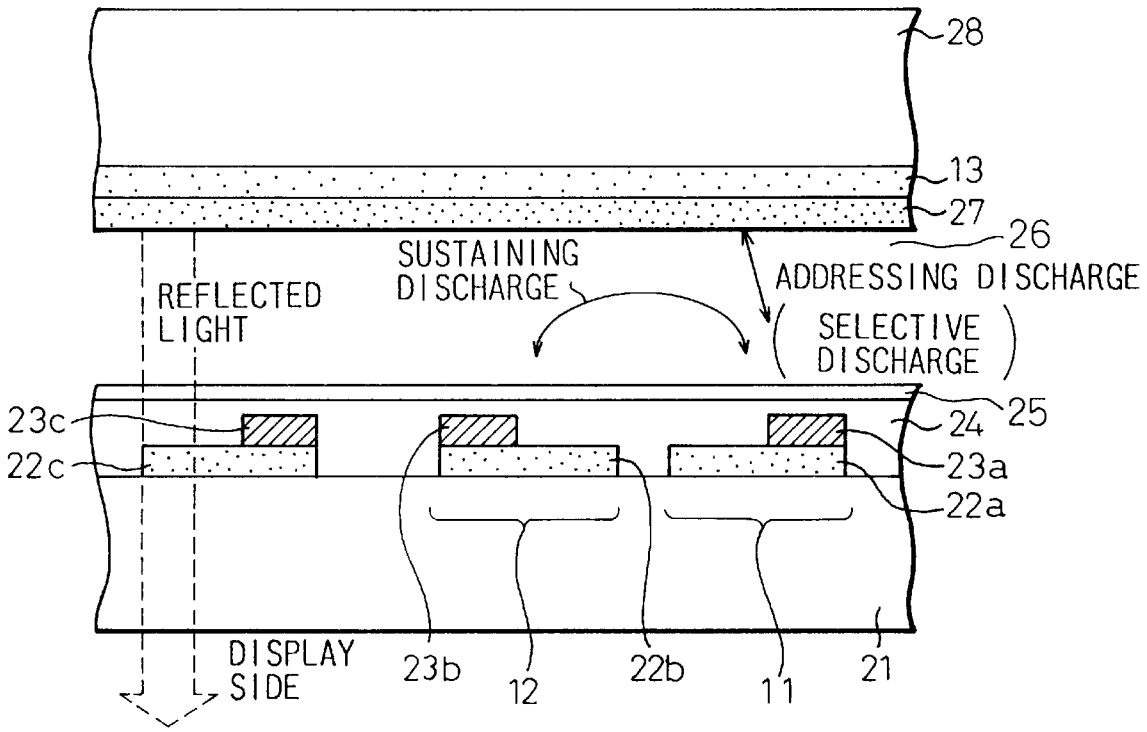
FIG. 2 is a schematic sectional view of the triple-electrode surface-discharge type AC PDP.
Figure 3:
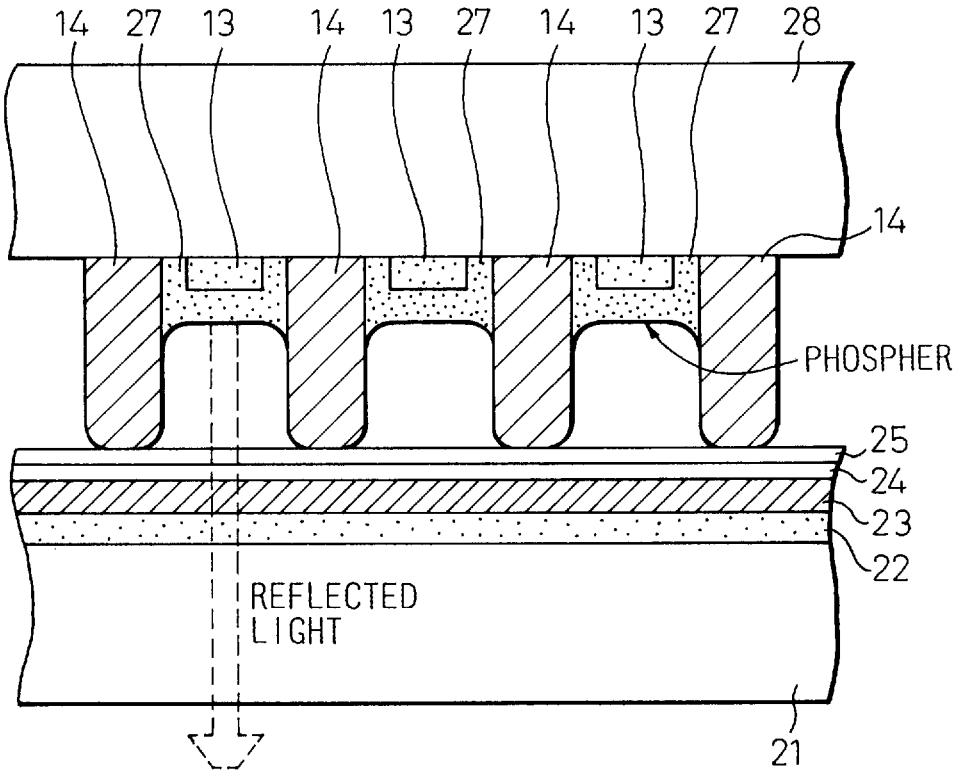
FIG. 3 is a schematic sectional view of the triple-electrode surface-discharge type AC PDP.

What is shown in the schematic plan view of FIG. 1 is known as the triple-electrode surface-discharge type PDP. FIG. 2 is a schematic sectional view (vertical direction) of one discharge cell in the panel shown in FIG. 1. FIG. 3 is a schematic sectional view showing one discharge cell in a horizontal direction. In the drawings to be referred to below, the same functional parts will be assigned the same reference numerals.

A panel comprises two glass substrates 21 and 28 (FIG. 2) The first substrate 21 includes first electrodes (X electrodes) 12 and second electrodes (Y electrodes) 13 which serve as sustaining electrodes and are parallel to one another. These electrodes are realized with transparent electrodes 22*a* and 22*b* and bus electrodes 23*a* and 23*b*. The transparent electrodes are designed to fill the role of transmitting reflected light stemming from phosphor and are therefore formed with an ITO (transparent conductive membrane whose main component is indium oxide) or the like. The bus electrodes must be formed to have a low resistance in order to prevent a voltage drop resulting from an electric resistance, and are therefore made of chromium (Cr) or copper (Cu). These electrodes are coated with an inductive layer (glass) 24. A membrane 25 made of magnesium oxide (MgO) is formed as a protective membrane on a discharge side. In a second substrate 28 opposed to the first glass substrate 21, third electrodes (address electrodes) 13 (FIG. 3) are formed orthogonally to the sustaining electrodes. Barriers 14 are formed among the address electrodes. A fluorescent substance 27 having a characteristic of glowing red, green, or blue is formed between each pair of barriers so that the phosphor can cover an address electrode. The two glass substrates are assembled so that the ridges of the barriers 14 can be in close contact with the MgO membrane 25. Spaces between the phosphor 27 and the MgO membrane 25 serve as discharge spaces 26 (FIG. 2).

Figure 4:
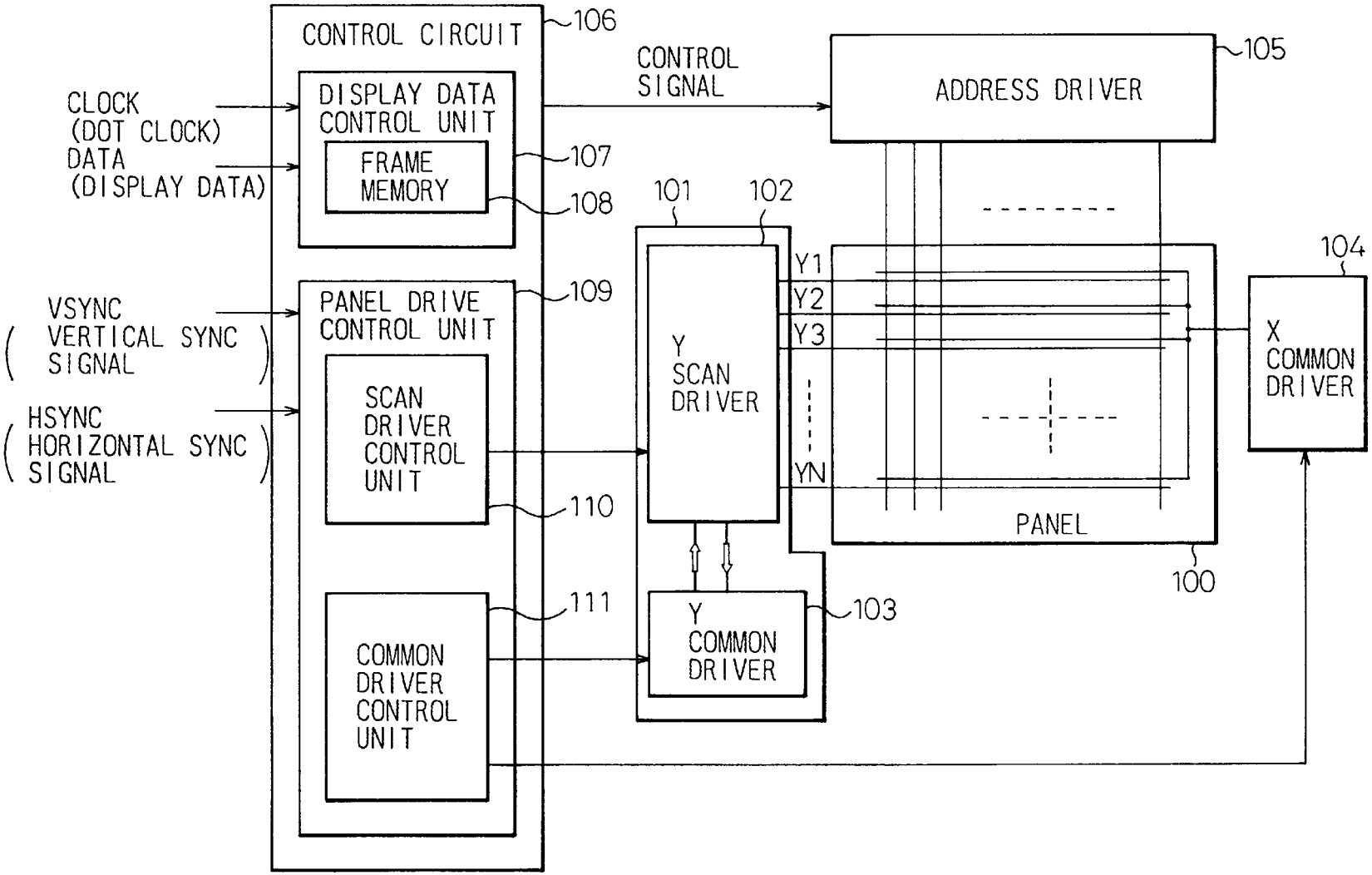
FIG. 4 is a block diagram of the triple-electrode surface-discharge type AC PDP.

FIG. 4 is a schematic block diagram showing peripheral circuits for driving the PDP shown in FIGS. 1 to 3. The address electrodes 13-1, 13-2, etc. are independently connected to an address driver 105. The address driver applies an addressing pulse for addressing discharge. The Y electrodes 11-1, 11-2, etc. are connected to a Y driver 101. The Y driver 101 comprises a Y scan driver 102 and a Y common driver 103. The Y electrodes are independently connected to the Y scan driver 102. The Y scan driver 102 is connected to the Y common driver 103. During addressing discharge, a pulse is generated by the Y scan driver 102. A sustaining pulse or the like is generated by the Y common driver 103, and applied to a Y electrode via the Y scan driver 102. The X electrodes 12 are connected in common along all display lines for signal fetching. An X common driver 104 generates a writing pulse, sustaining pulse, and the like. These driver circuits are controlled by a control circuit. The control circuit is controlled by synchronizing (hereinafter sync) signals and display data signals fed externally to the display.

In a PDP, the intensity of glowing cannot be varied. Gray-scale display is therefore achieved by varying the period of glowing to substantially vary luminance. Gray-scale display in the PDP is such that, generally, each bit of display data is associated with a period of a subfield, and the length of a subfield is varied according to the degree of weighing an associated bit. Taking 256-level gray-scale display for instance, display data is composed of eight bits. One frame is displayed during the period of eight sub-fields, and each bit data is displayed during an associated subfield. The ratio of the lengths of sub-fields is 1:2:4:8:16:32:64:128.

Figure 5:
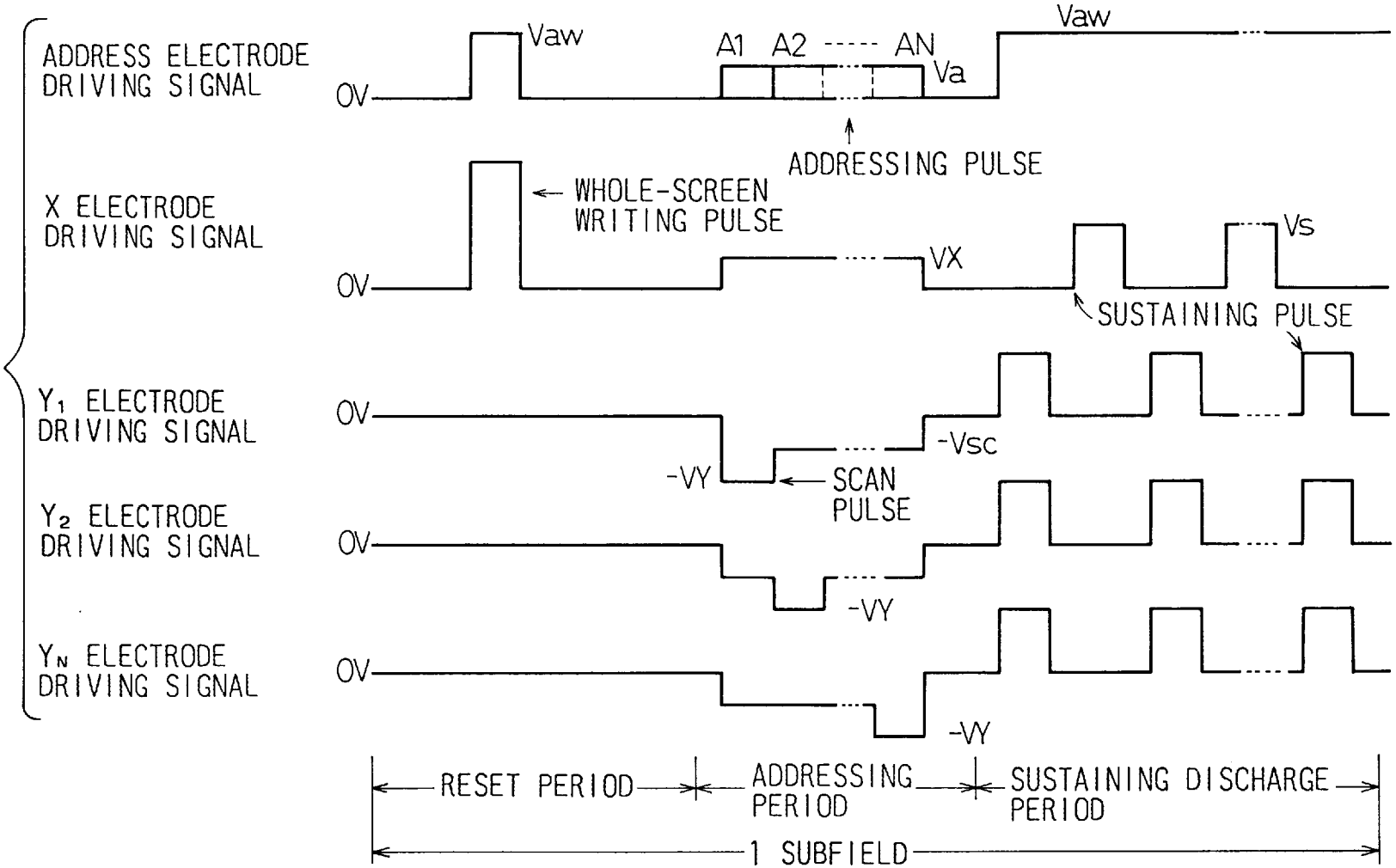
FIG. 5 is a chart showing known waveforms of driving signals.

FIG. 5 is a waveform chart illustrating a known method for driving the PDP shown in FIGS. 1 to 3 using the circuitry shown in FIG. 4. FIG. 5 is concerned with one subfield in the so-called known "writing addressing system at address sustain period separated sub-field method". In this example, one subfield is divided into a reset period, addressing period, and sustaining discharge period. During the reset period, all the Y electrodes are reset to the level of 0V. At the same time, a whole-screen writing pulse whose voltage is Vs+Vw (approximately 330V) is applied to the X electrodes. All the cells on all display lines then discharge irrespective of the ongoing display state. The potentials at the address electrodes at this time are approximately 100V (Vaw). The potentials at the X electrodes and address electrodes are 0V. At all the cells, the voltage induced by a wall charge itself exceeds a discharge start voltage. Discharge is then started. This discharge neutralizes by itself and ceases. This is what is called "self-erasure discharge." The self-erasure discharge brings all the cells in the panel into a uniform state devoid of a wall charge. The reset period exerts the effect of bringing all the cells into the same state irrespective of the lighting state during the previous subfield. Thus, the reset period is provided for executing the next addressing (writing) discharge on a stable basis.

During an addressing period, addressing discharge is executed line-sequentially in order to turn on or off the cells according to display data. First, a scan pulse of a−VY level (approximately −150V) is applied to the Y electrodes. An addressing pulse of a voltage Va (approximately 50V) is applied selectively to the address electrodes coincident with cells to be lit. Discharge occurs between the address electrodes and Y electrodes of the cells to be lit. The discharge acts as priming so as to bring about discharge between the X electrodes (voltage Vx=50V) and Y electrodes. Consequently, a quantity of wall charge enabling sustaining discharge is accumulated on the MgO membrane covering both the electrodes.

The aforesaid operation is performed sequentially for the other display lines. Eventually, new display data is written for all the display lines.

Thereafter, when it comes to a sustaining discharge period, a sustaining pulse of a voltage Vs (approximately 180V) is applied alternately to the Y electrodes and X electrodes. This results in sustaining discharge. An image for one subfield is displayed. At this time, a voltage Vaw of approximately 100V is applied to the address electrodes in order to prevent discharge from occurring between the address electrodes and the X electrodes or Y electrodes.

In the "addressing/sustaining discharge-separated writing addressing system," luminance is determined with the length of a sustaining discharge period; that is, the number of sustaining pulses.

Figure 6:
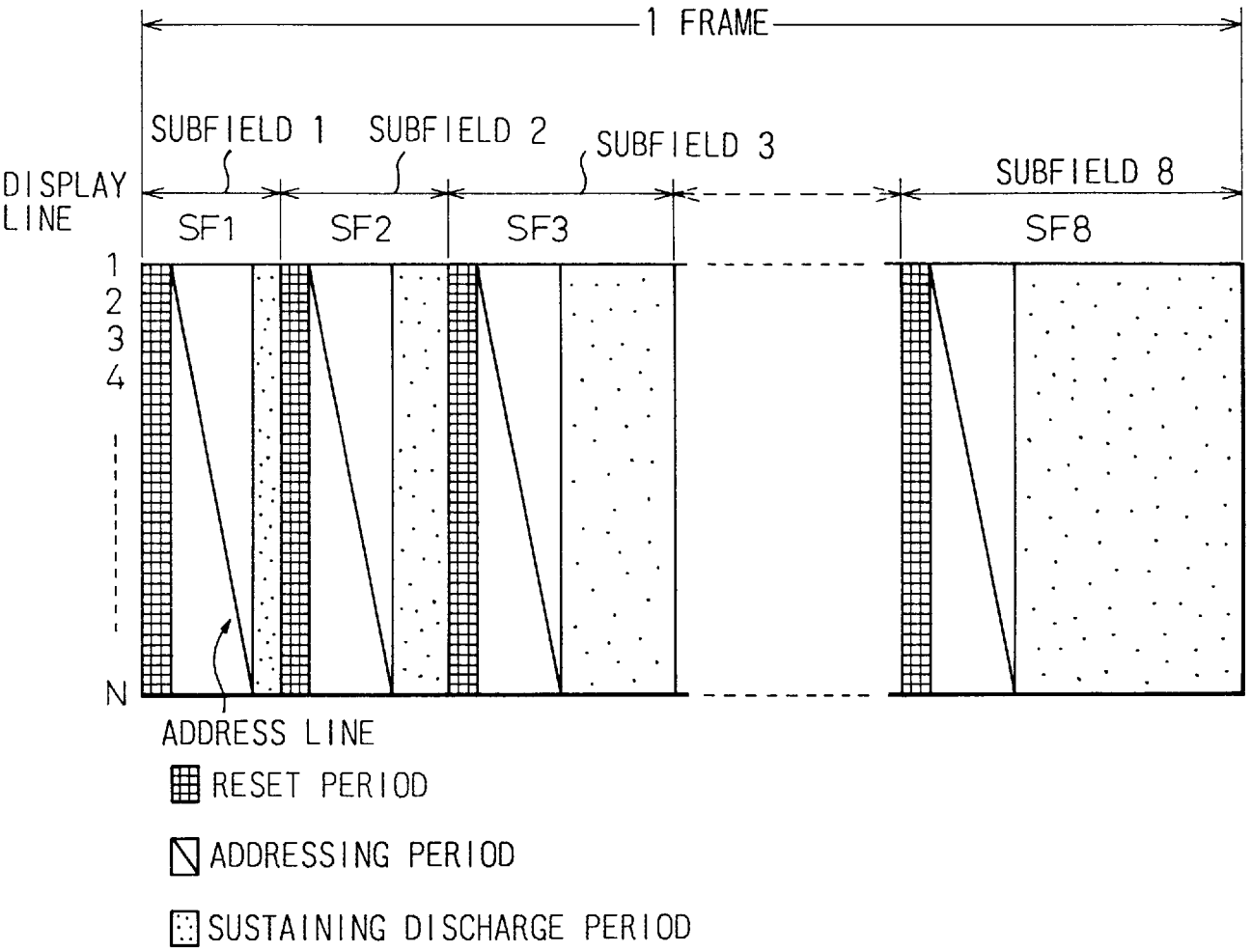
FIG. 6 is a timing chart concerning an address sustain period separated sub-field method for achieving gray-scale display in a PDP.

A driving method adaptable for 256-level gray-scale display is shown as an example for multilevel gray-scale display in FIG. 6. In this example, one frame is segmented into eight subfields SF1 to SF8.

Within the subfields SF1 to SF8, reset periods and addressing periods have the same lengths. The ratio of lengths of sustaining discharge periods is 1:2:4:8:16:32:64:128. By selecting subfields during which lighting is effected, a difference in luminance can be displayed in 256 gray-scale levels ranging from level 0 to 255.

As described above, as far as the known driving method for an AC plasma display panel (PDP) is concerned, when the panel has 1000 display lines, 1000 addressing cycles are needed. For gray-scale display, one frame must be composed of several subfields associated with different glowing frequencies. The number of addressing cycles corresponding to the number of display lines is therefore needed for each subfield.

For brighter display, the number of sustaining discharges must be large. A method of packing many sustaining discharge cycles into a certain period of time is conceivable. For sufficiently exerting the memory effect and operating a PDP at a lower voltage (with smaller power), the duration of a sustaining pulse must be made longer. Normally, a pulse duration of about 5 microseconds is needed. When power is sacrificed, if a high voltage is applied, a pulse duration of about 3 microseconds would enable sustaining discharge. The pulse duration would be a borderline. For high-luminance display, the sustaining discharge period within a frame must be made longer. For attaining a long sustaining discharge period, it is required to give up an addressing period that is a period not contributing to glowing. In this case, since a time ranging from 3 to 5 microseconds is needed for stable addressing discharge, multilevel gray-scale display cannot be achieved in a panel having a lot of display lines. When priority is given to the number of display lines and multilevel gray-scale display, luminance will be sacrificed.

As mentioned above, luminance (number of sustaining discharges), and gray-scale display, the number of display lines, or a voltage have the relationship of a trade-off. This posed a problem impeding a full-color high-luminance display in a high-definition large-screen panel.

A subfield method employed as a technique for performing gray-scale display using a plasma display unit has the foregoing problem of the impediment attributable to a temporal restriction as well as a problem that, since a screen glowing during one frame is temporally divided, when an animated image is displayed, the image is seen split by a subfield and is therefore perceived as unnatural.

Figure 7:
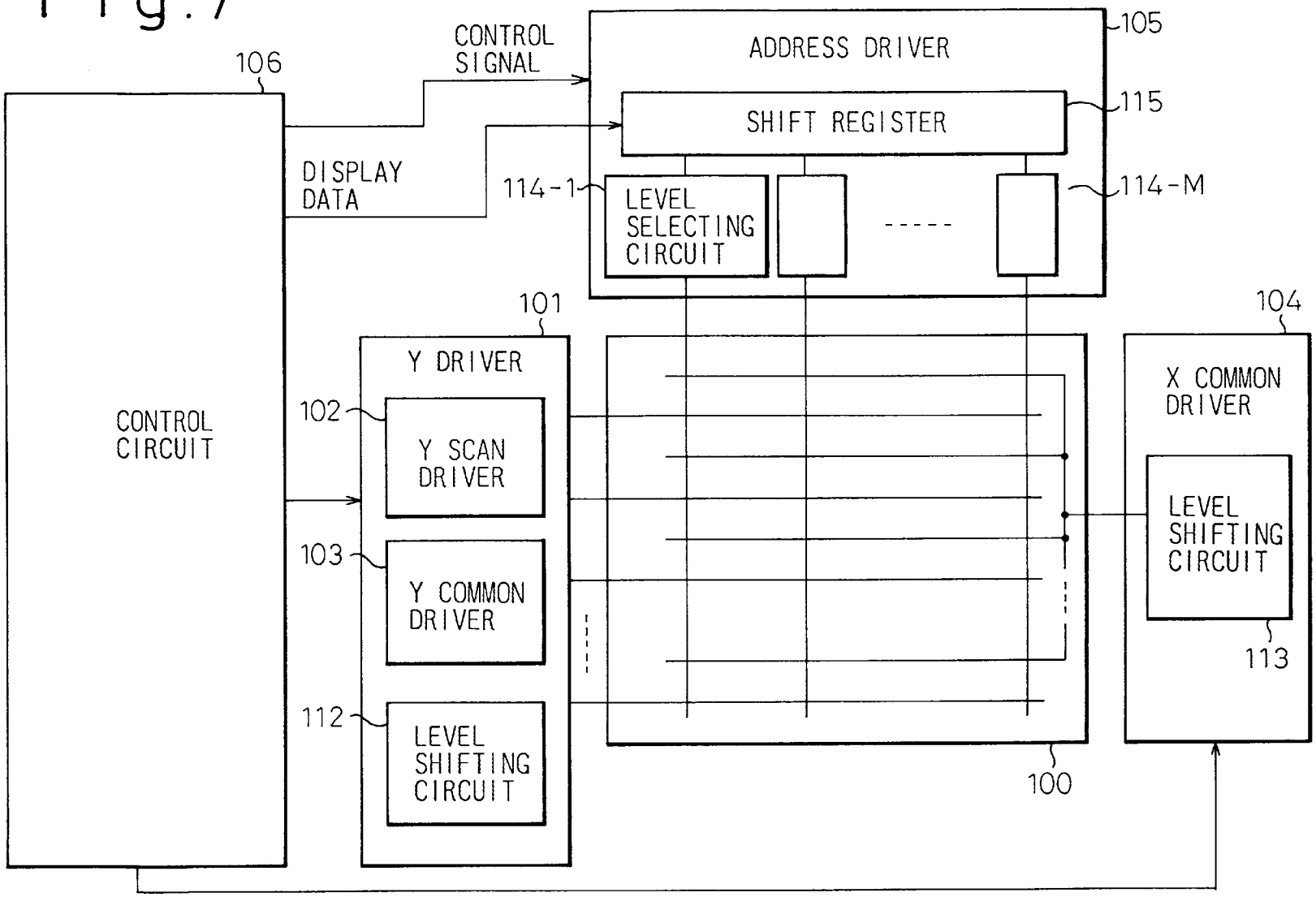
FIG. 7 is a diagram showing the overall configuration of a PDP of the first embodiment of the present invention.

FIG. 7 is a diagram showing the overall configuration of a triple-electrode AC plasma display panel (PDP) of the first embodiment of the present invention.

In FIG. 7, reference numeral 100 denotes a plasma display panel. 101 denotes a Y driver. 102 denotes a Y scan driver. 103 denotes a Y common driver. 104 denotes an X common driver. 105 denotes an address driver. 106 denotes a control circuit. 112 denotes a level shifting circuit for the Y driver 101. 113 denotes a level shifting circuit for the X common driver 104. 114-1 to 114-M denote level selecting circuits for the address driver 105. 115 denotes a shift register.

The plasma display panel of this embodiment has the same structure as the known panel shown in FIGS. 1 to 3. The Y driver 101, X common driver 104, and address driver 105 have the same circuitries as those in the known panel except that the drivers include the level shifting circuits 112 and 113, and the level selecting circuits 114-1 to 114-M respectively, so that voltages to be applied to the Y electrodes, X electrodes, and address electrodes can be varied among a larger number of levels than those in the known panel. Herein, the different points alone will be described. The control circuit 106 has the same circuitry as that in the known panel except the circuitry for shifting the levels of voltages to be applied to the Y electrodes, X electrodes, and address electrodes.

The drive circuits of the first embodiment for Y, X, and address electrodes each include a level shifting circuit. Necessary circuits are limited on the basis of the waveforms of driving signals to be applied which are described below.

Figure 8:
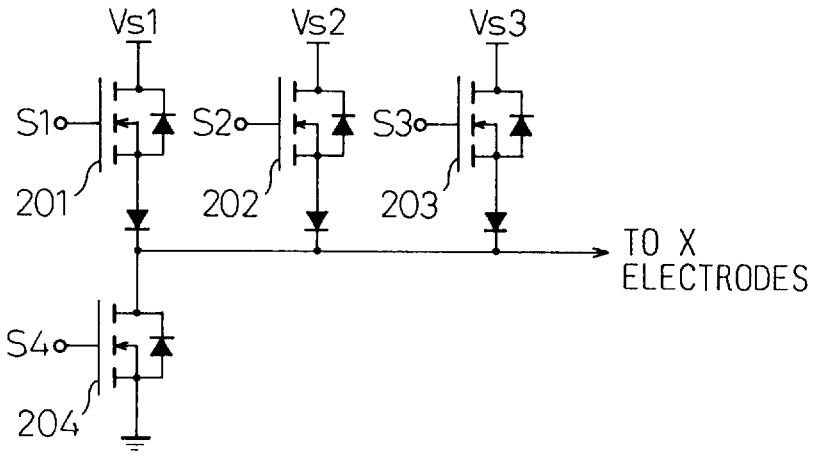
FIG. 8 is a diagram showing the circuitry of an X common driver of the first embodiment.
Figure 9:
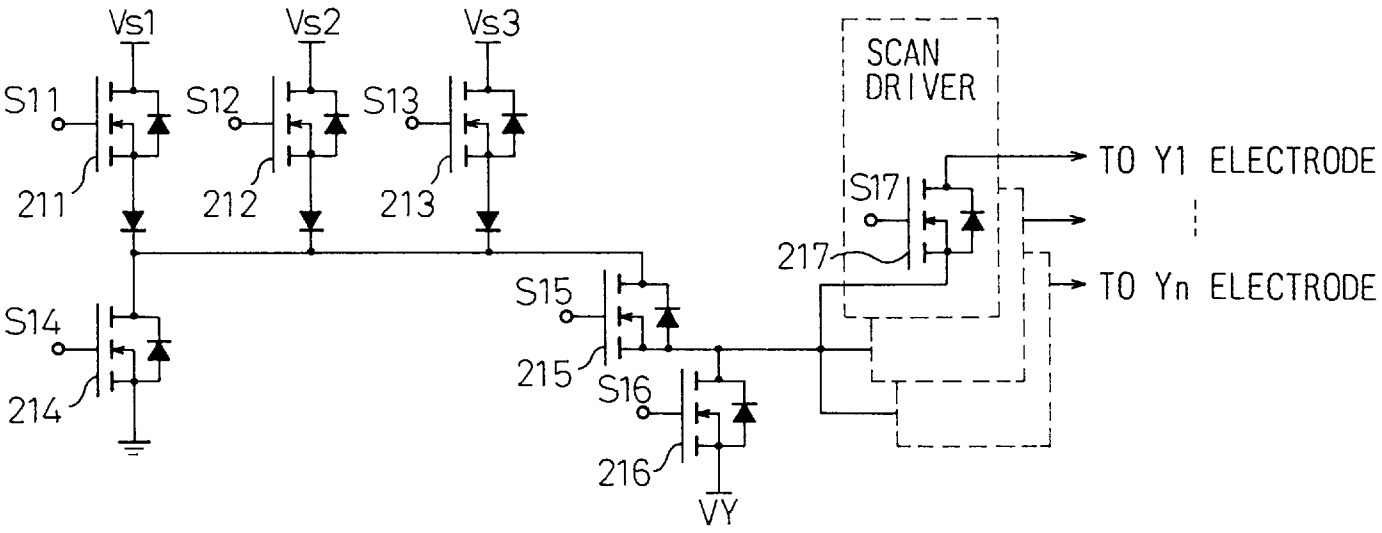
FIG. 9 is a diagram showing the circuitry of a Y driver of the first embodiment.
Figure 10:
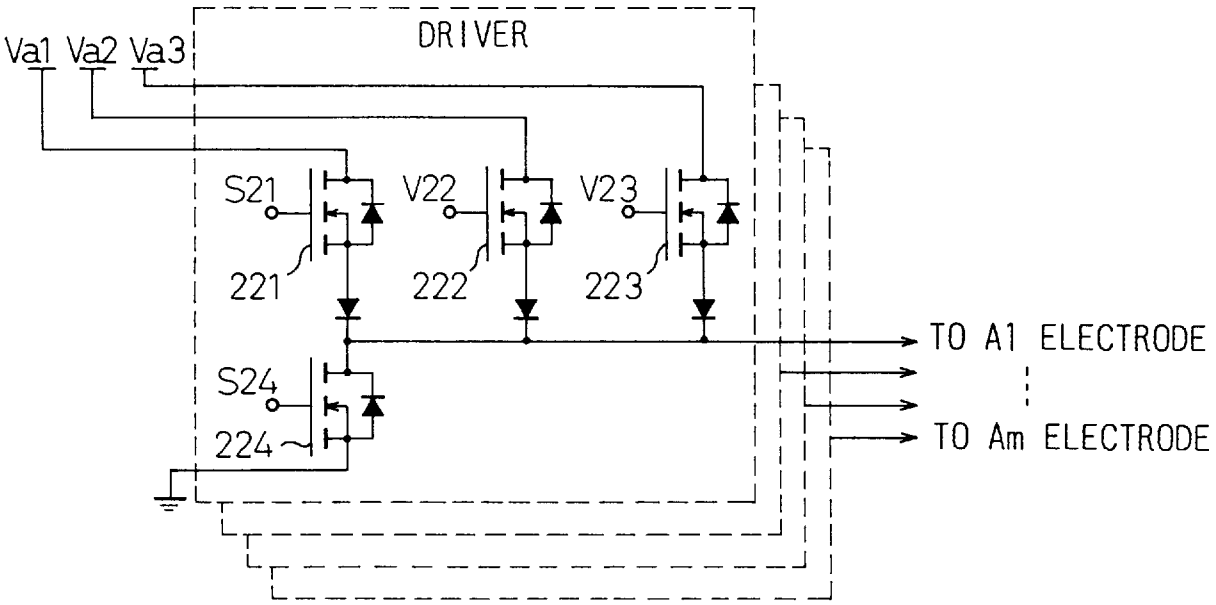
FIG. 10 is a diagram showing the circuitry of an address driver of the first embodiment.

FIGS. 8 to 10 show drive circuits for applying driving signals of the first embodiment to different kinds of electrodes. In these drawings, only a high-voltage unit for applying a voltage to electrodes is illustrated. A control unit for producing a control signal and a power circuit for supplying power to the high-voltage unit are omitted.

FIG. 8 is a schematic view of a circuit in the X common driver 104. For generating a ternary sustaining pulse for X electrodes during a sustaining discharge period, the X common driver 104 is composed of field-effect transistors (hereinafter FETs) 201, 202, and 203, which are switching devices connected to three kinds of power supplies Vs1, Vs2, and Vs3, and an FET 204 connected to a ground (hereinafter GND) (OV). Signals S1, S2, S3, and S4 are applied to the gates of the respective FETs. During a first sustaining period that is the first segment of a sustaining period, the FET 201 and FET 204 perform switching alternately. During a second sustaining period that is the second segment of the sustaining period, the FET 202 and FET 204 perform switching alternately. During a third sustaining period that is the third segment of the sustaining period, the FET 203 and FET 204 perform switching alternately. Thus, a sustaining pulse of a given voltage is applied to the X electrodes. Incidentally, the known panel includes only a circuit composed of the FET 201 and FET 204 because a sustaining pulse to be applied is switched between a certain voltage Vs shown in FIG. 5 and 0V.

FIG. 9 is a schematic view of a circuit for driving the Y electrodes. An FET 211 to FET 216 correspond to the Y common driver 103. FETs 217 correspond to the Y scan driver 103. The FETs 217 are installed in one-to-one correspondence to the Y electrodes. The FET 211 to FET 214 operate in the same way as the X common driver 104, and perform switching alternately during the respective sustaining periods. During an addressing period, the FET 215 is turned off, the FET 217 that is a scan driver associated with a selected Y electrode is turned on, and then the FET 216 is turned on. This causes the potential at the selected Y electrode to rise to a given potential VY. This operation is performed successively on selected electrodes. During a sustaining discharge period, the FET 215 and FET 217 remain on. Supply and leading-in of current to the Y electrodes are achieved by way of the FET 215 and FET 217 (and diodes incorporated therein).

FIG. 10 is a schematic view of a circuit for driving address electrodes; that is, a so-called level selecting circuit in the address driver 105. This kind of level selecting circuit is connected in one-to-one correspondence to the address electrodes. The bits of a ternary addressing pulse to be generated for an address electrode are produced by FETs 221, 222, and 223 connected to three kinds of power supplies Va1, Va2, and Va3, and an FET 224 connected to the GND (0V). According to an intended voltage, any of the FETs is turned on. Thus, a given addressing pulse is applied.

PDPs of the second to sixth embodiments to be described below have the same structure as the PDP of the first embodiment.

Figure 11:
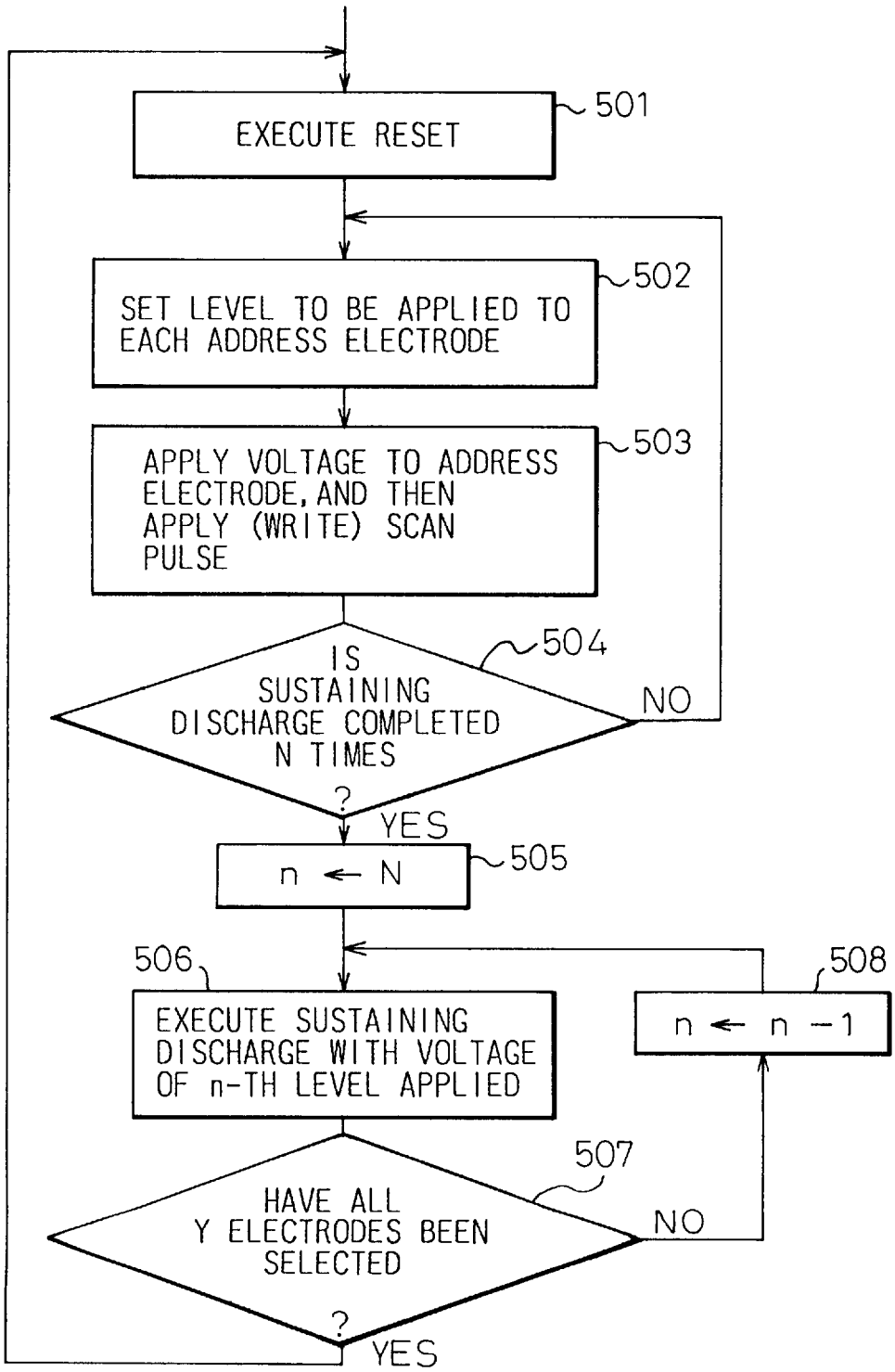
FIG. 11 is a chart describing a basic operation in the first embodiment.

FIG. 11 is a flowchart describing operations in the first embodiment. The basic operations in the first embodiment will be described with reference to the flowchart, and then explained more particularly using a timing chart.

First, at step 501, a reset as shown in FIG. 5 is executed.

At step 502, a level to be applied to an address electrode is selected according to the first string of display data sent from the control circuit 106.

At step 503, any of signals S21, S22, S23, and S24 in FIG. 10 is driven high according to the level selected at step 502. A voltage corresponding to the display data is then applied to the address electrode. At the same time, a signal S15 in FIG. 9 is driven low, a signal S16 is driven high, and a signal S17 to be applied to the gate of the FET to be connected to a selected Y electrode is driven high. This causes a discharge whose intensity is proportional to the voltage applied to the address electrode to occur between the selected Y electrode and address electrode. When a voltage of 0V is applied to the address electrode, discharge does not occur.

The operations of steps 502 and 503 are repeated until all the Y electrodes are selected. At step 504, it is judged whether the operations of steps 502 and 503 are completed for all the Y electrodes. If the operations are completed, writing is terminated.

At step 505, a value N is stored in a register n.

At step 506, a voltage of the n-th level of N steps of levels is applied. Sustaining discharge is then executed for a period predetermined in association with the level. Specifically, the signal S15 in FIGS. 8 and 9 is driven high. The n-th one of the pairs of signals S1 and S11, S2 and S12, and S3 and S13, and the pair of signals S4 and S14 are driven high alternately.

At step 507, it is judged whether N-steps of sustaining discharge have been completed. In practice, it is judged whether the register n indicates a value of zero. At step 508, the value stored in the register n is decremented by 1, and control is returned to step 506.

Thus, the display of one screen (frame) is completed. If gray-scale display is achieved partly by varying the lengths of subfields within one frame and partly by varying the strength of a writing voltage in accordance with the present invention, a series of operations described in FIG. 11 is executed for each subfield in order to complete the display of one frame.

Next, the operations in the first embodiment will be described in conjunction with a timing chart.

Figure 12:
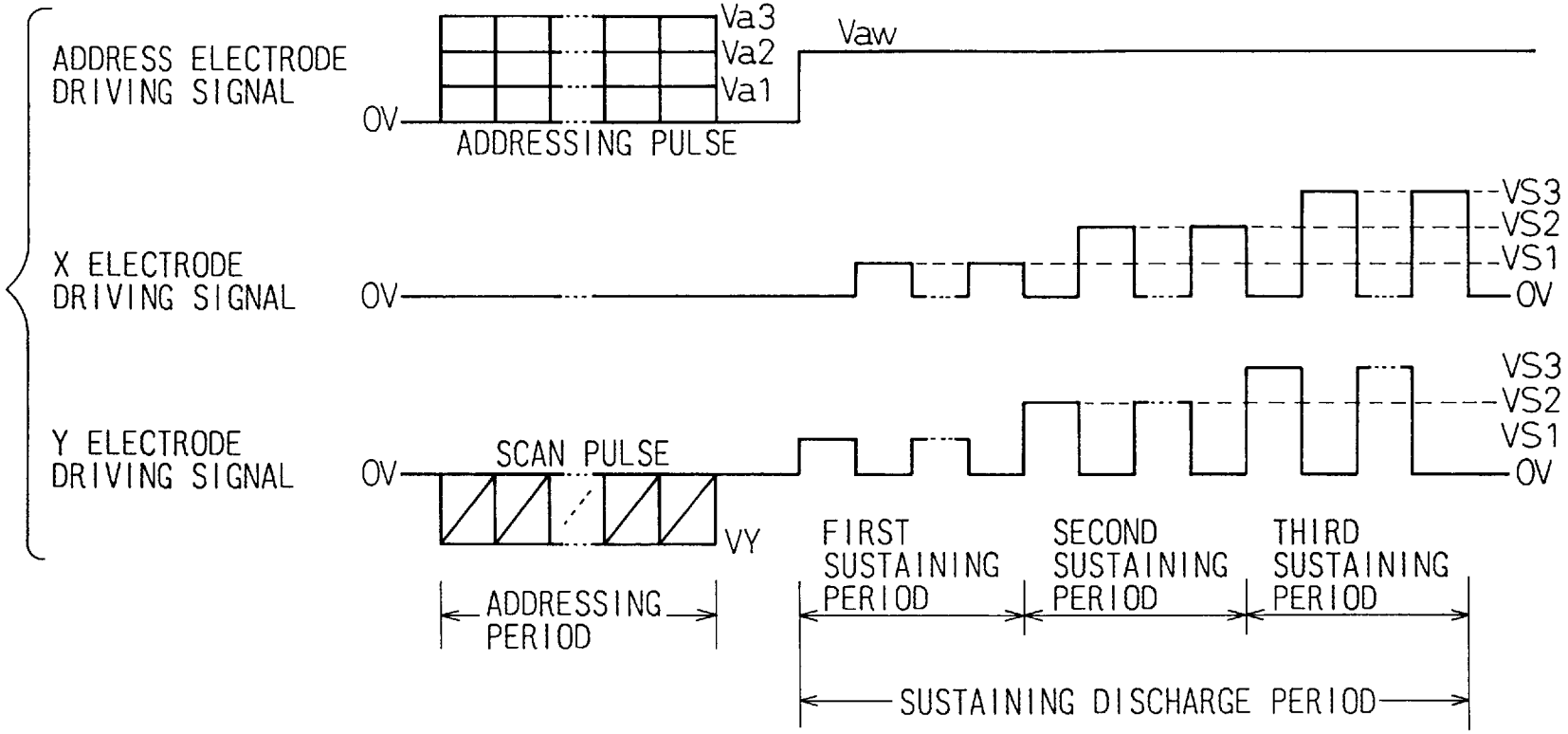
FIG. 12 is a chart showing waveforms of driving signals in the first embodiment.

FIG. 12 is a chart showing waveforms of driving signals to be applied to different kinds of electrodes in the first embodiment of the present invention.

In the present invention, a pulsating voltage to be applied to address electrodes is varied depending on display data; that is, luminance requested for cells to be lit. The pulsating voltage to be applied to the address electrodes assumes four values of 0V, Va1, Va2, and Va3 including unselected potentials. The scale of discharge occurring when a scan pulse is applied is determined according to whichever voltage value an addressing pulse assumes. The quantity of wall charge to be stored in discharge cells as a result of the discharge; that is, an induced voltage also assumes different values. According to this technique, a voltage induced by a wall charge (which shall be referred to as a wall voltage) is selective from among four values including 0V at which discharge is not executed. When scanning of a given display line is completed, a sustaining discharge period starts.

A sustaining discharge pulse assumes three values. The timing of starting discharge is varied depending on a difference of a wall voltage produced during an addressing period from another. To be more specific, in a cell that is unselected because an addressing pulse of 0V is applied, since the wall voltage is 0V, discharge is not started with any sustaining pulse. In a cell in which addressing discharge has occurred with an addressing pulse of a voltage Va1, since the wall voltage produced is small, discharge can be started only with a sustaining pulse of a large voltage. Sustaining discharge is started at the time of application of a sustaining voltage VS3. In a cell in which addressing discharge has occurred with an addressing pulse of a voltage Va2, since the wall voltage produced is medium, sustaining discharge is continued from the time of application of a sustaining voltage VS2. Sustaining discharge is executed even at the time of application of a sustaining pulse VS3. In a cell in which addressing discharge has occurred with an addressing pulse of a voltage Va3, since the wall voltage produced is large, discharge can be started with a sustaining pulse of a low voltage. Discharge is therefore started with the first sustaining pulse of a voltage VS1, and continued thereafter.

Taking the characteristics of one panel for instance, actual conditions concerning voltages will be presented below. A discharge start voltage (Vfay) triggering discharge between an address electrode and Y electrode is 150V. A lower limit (Vsm) of a sustaining voltage required for executing sustaining discharge between an X electrode and Y electrode is 150V. A discharge start voltage required for starting discharge between an X electrode and Y electrode is 220V. The voltage of a scan pulse (−VY) NO is −140V. The voltage Va1 of an addressing pulse is 20V. The voltage Va2 thereof is 40V. The voltage Va3 thereof is 60V. The voltage VS1 of a sustaining pulse is 160V. The voltage VS2 thereof is 180V. The voltage VS3 thereof is 200V. When an addressing pulse of the voltage Va1 (20V) is applied and a scan pulse (−VY=−140V) is applied to a Y electrode, a potential difference between the address electrode and Y electrode becomes 160V. Since the potential difference exceeds the discharge start voltage triggering discharge between the address electrode and Y electrode, addressing discharge is executed. A wall voltage developed between the Y electrode and X electrode due to this discharge is about 30V. With application of a sustaining pulse of the voltage VS3 (200V), the sum of the wall voltage and applied voltage exceeds the discharge start voltage of 220V. Sustaining discharge is therefore started. When an addressing pulse of the voltage Va3 (60V) is applied, the sum of the voltage and a scan pulse reaches 200V. A wall voltage developed between the Y electrode and X electrode as a result of addressing discharge is about 70V. At the time of application of the first sustaining voltage of 160V, the sum of the wall voltage and applied voltage exceeds the discharge start voltage. Sustaining discharge is then started. In the cell concerned, discharge is repeated until the sustaining discharge period comes to an end.

As mentioned above, in the first embodiment, a difference in brightness can be expressed in four steps. For expressing four gray-scale levels, two subfields have needed in the past. The present invention requires only one subfield to express four gray-scale levels.

Figure 13:
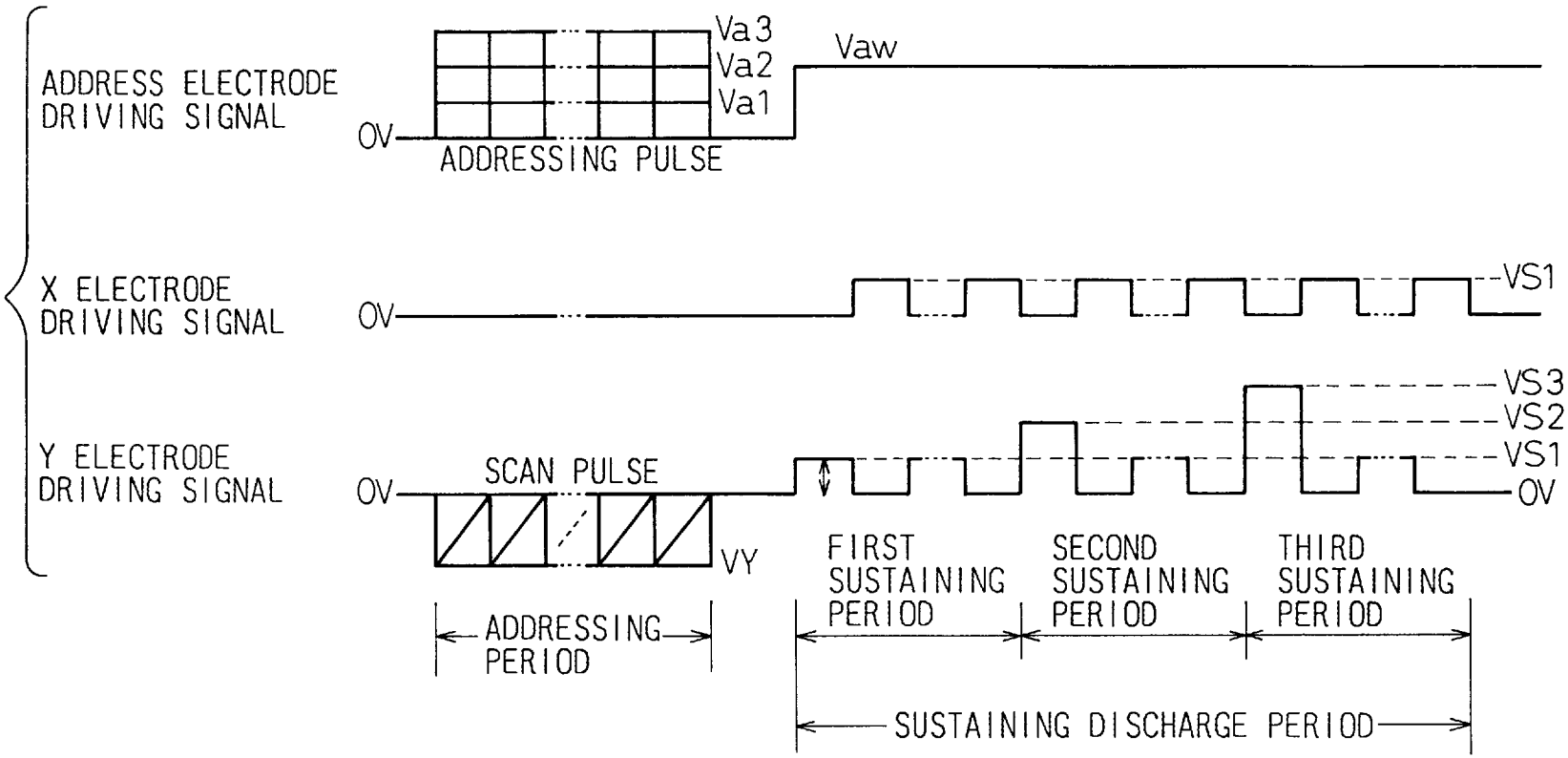
FIG. 13 is a chart showing waveforms of driving signals in the second embodiment.

FIG. 13 is a waveform chart showing driving signals in the second embodiment of the present invention. The operations of the second embodiment will be described in conjunction with FIG. 13.

The operation during an addressing period is identical to that in the first embodiment. As for a sustaining pulse to be applied during a sustaining discharge period, a sustaining pulse of the voltage VS1 is applied repeatedly. In a cell which has discharged with an addressing pulse of the voltage Va3 and to which sustaining pulses of the voltages VS2 and VS3 are applied during specific periods, discharge occurs with the first sustaining pulse. In a cell which has discharged with an addressing pulse of the voltage VS1 and in which a small wall voltage is developed, discharge is started at the time of application of a sustaining pulse of the voltage VS3. Thereafter, the discharge is repeated even with a sustaining pulse of a small voltage.

A difference between the first embodiment and second embodiment will be described. In general, plasma displays have the characteristic that the intensity of discharge is determined with an applied voltage, and luminance gets higher according to the intensity. In the first embodiment, one discharge occurring during the third sustaining period provides higher luminance than that occurring during the first sustaining period. In the second embodiment, discharge is repeated to provide a certain level of luminance except when discharge is started with sustaining pulses of the voltages VS2 and VS3 that are inserted momentarily. Luminance is therefore made at the same level among all sustaining periods and is determined only by the number of sustaining discharges. (The influence of the discharges started with the sustaining pulses of the voltages VS2 and VS3 is negligible compared with that of all the discharges repeatedly occurring with the voltage VS1 during a sustaining discharge period.)

When a voltage value of an addressing pulse is selected according to a linear luminance ratio; that is, when a ratio of luminance levels to be displayed is 1:2:3, in the second embodiment, the first, second, and third sustaining periods (that is, the numbers of sustaining pulses) may have the same length. By contrast, in the first embodiment, the third sustaining period must be shorter than the first sustaining period. This is because since one discharge occurring during the third sustaining period provides a higher level of glowing luminance, a given luminance level can be attained with a limited number of discharges. In other words, a luminance level should be the same among the first, second, and third periods. When a nonlinear luminance ratio is wanted, the numbers of sustaining pulses to be applied during the respective sustaining periods should be set according to the characteristic.

In the aforesaid embodiments, four luminance levels are expressed during one subfield. A larger number of gray-scale levels can be expressed by increasing the number of steps of values to be assumed by an addressing pulse or sustaining pulse. Ultimately, as long as drive circuits can be innovated, luminance can be expressed in infinite steps; that is, as it is in analog form.

Figure 14:
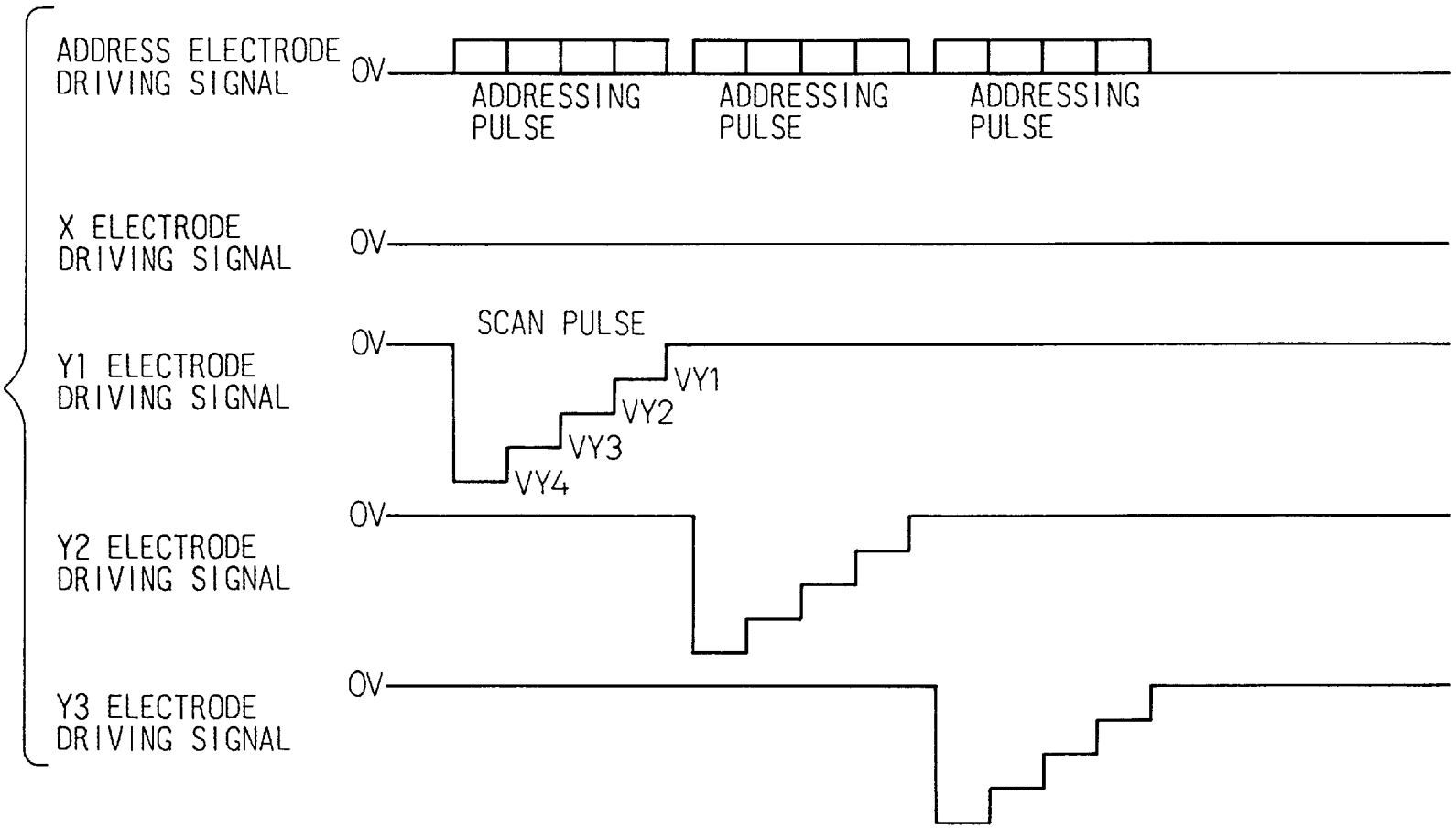
FIG. 14 is a chart showing waveforms of driving signals in the third embodiment.

FIG. 14 is a waveform chart concerning the third embodiment.

FIG. 14 shows only the voltages applied during an addressing period. The operation during a sustaining discharge period is identical to that in the first or second embodiment.

In the third embodiment, an addressing pulse of a certain voltage alone is applied. The voltage of a scan pulse is decreased gradually during a selection period for one display line. For expressing the highest luminance level, since a high wall voltage must be developed as it is in the first and second embodiments, an addressing pulse is applied when a scan pulse assumes the highest voltage (VY4). For expressing the lowest luminance level, an addressing pulse is applied when a scan pulse has the lowest voltage (VY1). This operation is performed successively, whereby a wall voltage associated with a gray-scale level represented by display data can be developed in all display cells.

In the third embodiment, the voltage of a scan pulse must be varied in four steps. For realizing this operation, for example, a circuit composed of FETs 211 to 213 should be installed in the Y scan drivers connected to the respective Y electrodes in the circuit shown in FIG. 9. Since the number of steps is four, another FET is added and four kinds of power supplies are used to supply power to these FETS.

Figure 15:
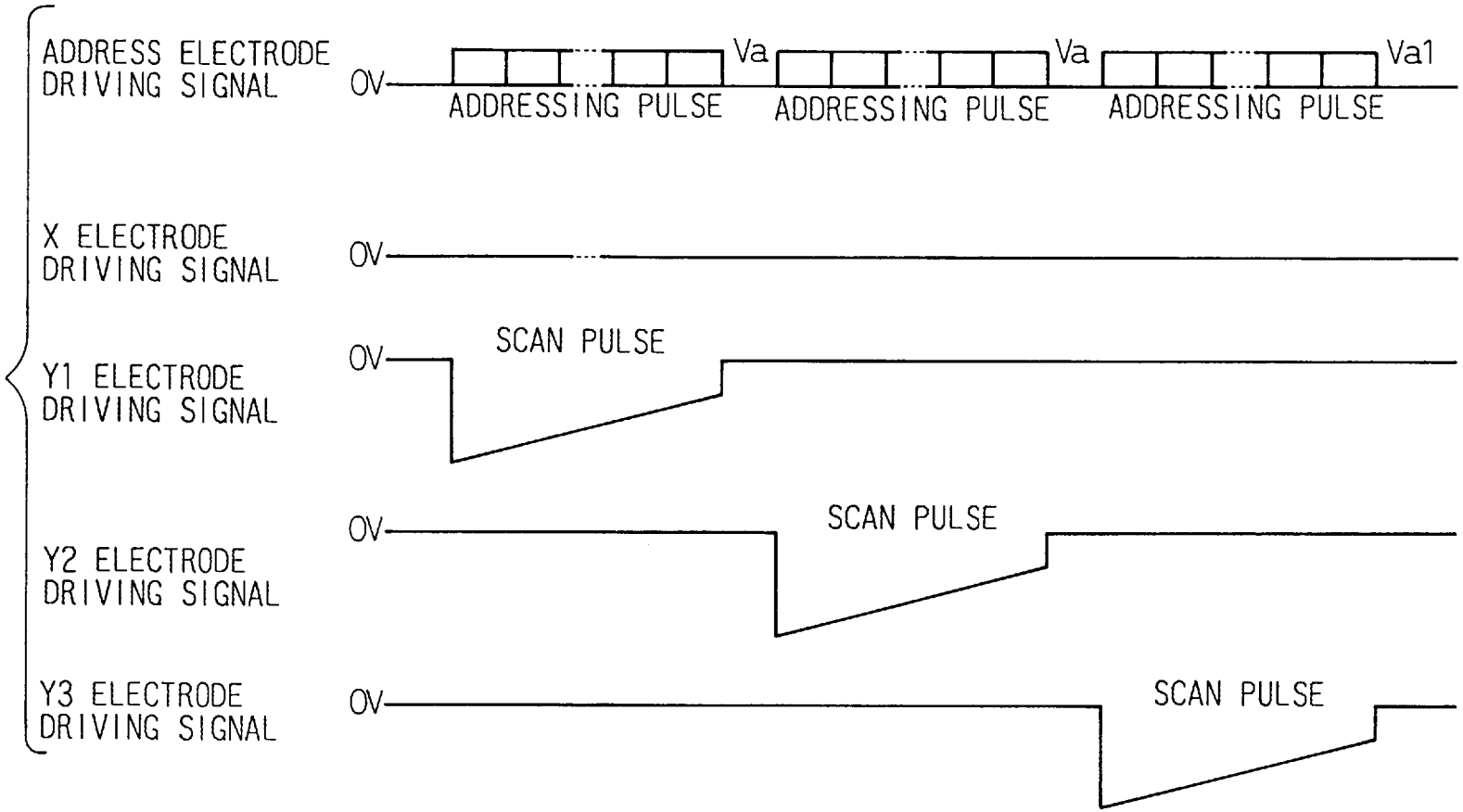
FIG. 15 is a chart showing waveforms of driving signals in the fourth embodiment.

FIG. 15 is a waveform chart concerning the fourth embodiment. Basically, the fourth embodiment is identical to the third embodiment. In this embodiment, the voltage of a scan pulse can be varied as it is in analog form and the timing of applying an addressing pulse can thus be varied accordingly. Herein, when a sustaining pulse varying as an analog quantity is used in combination, gray-scale can be expressed as it is in analog form.

Speaking of the relationship between pulsating voltages and a panel characteristic, the panel characteristic is set so that the sum of the lowest voltage of a scan pulse and the voltage of an addressing pulse will slightly exceed a discharge start voltage triggering discharge between an address electrode and Y electrode. The highest voltage of a scan pulse is set to a value not allowing discharge to occur between the Y electrode and an X electrode at which the potential is 0V.

In the fourth embodiment, the voltage of a scan pulse must be varied continuously as it is in analog form. For realizing this kind of operation, for example, an amplifying circuit including an operational amplifier or the like is installed in each of the Y scan drivers connected to the respective Y electrodes in the circuit shown in FIG. 9 so that a signal varying linearly can be applied.

Figure 16:
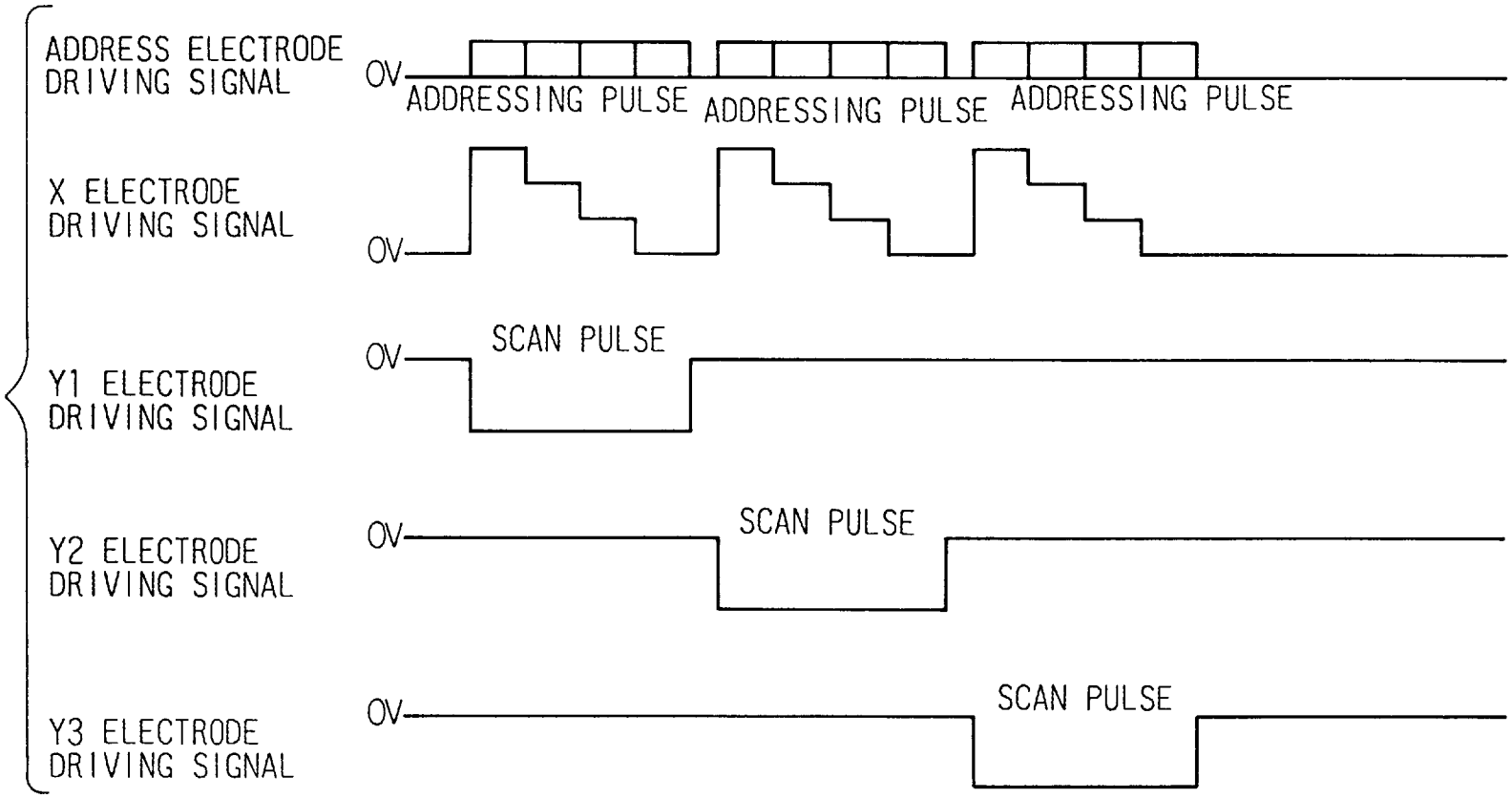
FIG. 16 is a chart showing waveforms of driving signals in the fifth embodiment.

FIG. 16 is a waveform chart concerning the fifth embodiment. In FIG. 16, only the voltages applied during an addressing period are shown. The operation during a sustaining discharge period is identical to that in the first or second embodiment.

In the fifth embodiment, an addressing pulse and scan pulse of certain voltages alone are applied. During a selection period for one display line, the potential at an X electrode is decreased gradually. For expressing the highest luminance level, since a high wall voltage must be developed as it is in the first and second embodiments, an addressing pulse is applied at the time when the potential at an X electrode becomes highest. For expressing the lowest luminance level, an addressing pulse is applied a the time when the potential at an X electrode becomes lowest. By performing this operation successively, a wall voltage associated with a gray-scale level represented by display data can be produced in all display cells.

In the fifth embodiment, it is required to vary an output of the X common driver 104 stepwise during an addressing period. The X common driver 104 performs a similar operation during a sustaining discharge period. The circuit shown in FIG. 8 can therefore be used to vary a signal to be supplied.

Figure 17:
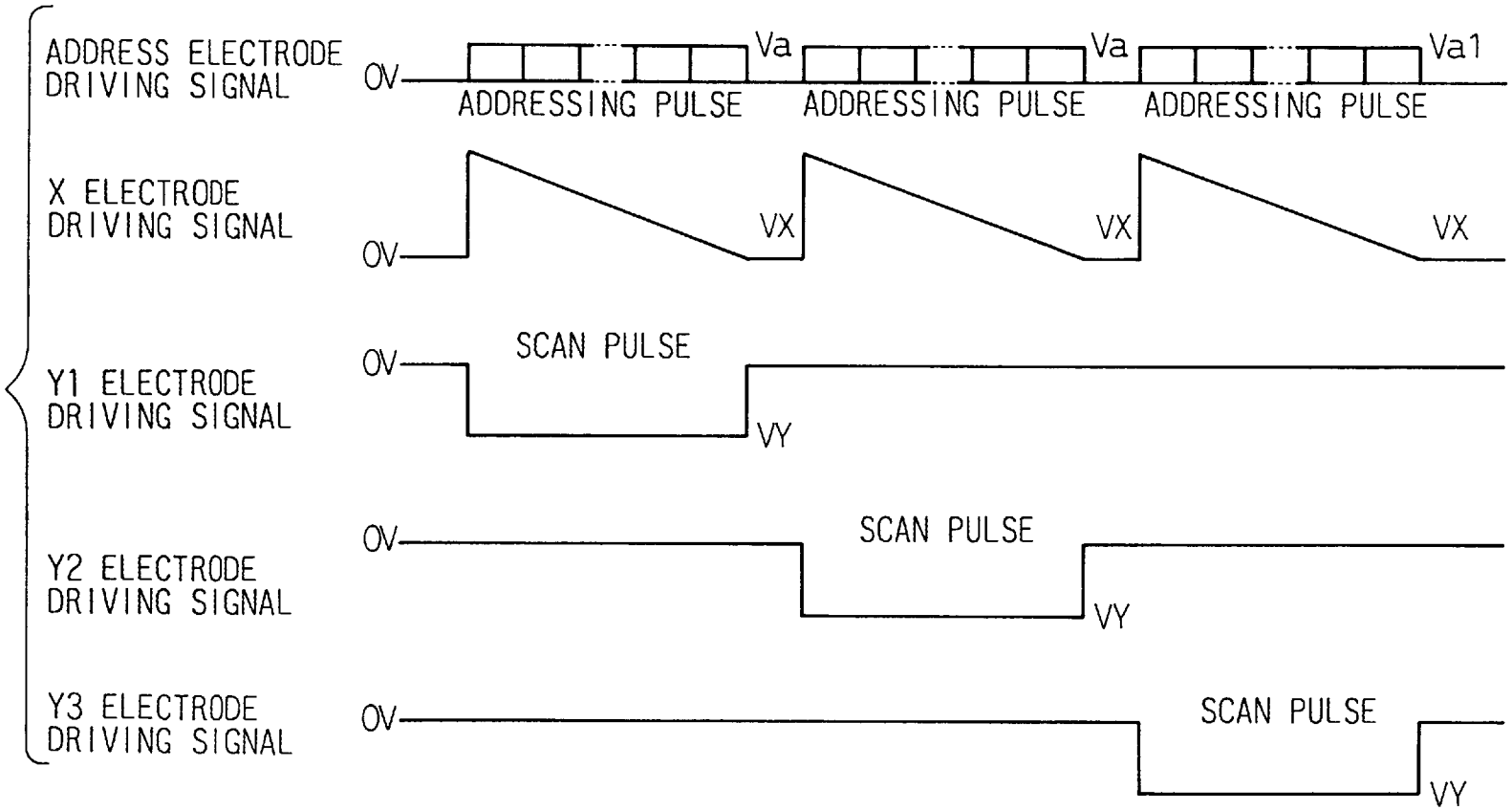
FIG. 17 is a chart showing waveforms of driving signals in the sixth embodiment.

FIG. 17 is a waveform chart concerning the sixth embodiment. The basic operation is identical to that in the fifth embodiment. In this embodiment, the potential at an X electrode is varied as it is in analog form, and the timing of applying an addressing pulse is thus varied accordingly as it is in analog form. Herein, as long as sustaining pulse can be varied as it is in analog form, gray-scale can be expressed as it is in analog form.

Speaking of the relationship between pulsating voltages and a panel characteristic, the panel characteristic is set so that the sum of the voltages of a scan pulse and addressing pulse will slightly exceed a discharge start voltage triggering discharge between an address electrode and Y electrode. The highest potential at an X electrode is set to a value not allowing discharge to start in relation to the voltage of a scan pulse.

In the sixth embodiment, it is required that an amplifying circuit including an operational amplifier or the like, similar to the one employed in the fourth embodiment, is installed in an X common driver in order to apply a signal varying linearly.

As described so far, according to the present invention, multi-step luminance can be expressed during one subfield. A full-color high-luminance display can be realized in a high-definition large-screen panel without the restrictions that have been imposed on luminance (number of sustaining discharges) and gray-scale display or the number of display lines in the past. Furthermore, glowing display of a screen for one frame can be made temporally intensive. Consequently, unnaturalness in display of an animated image can be eliminated to improve display quality.

I claim:

1. A driving method for a plasma display, the plasma display having a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes; the driving method comprising during an addressing period, applying a scan pulse successively to said plurality of second electrodes, one display line coincident with a selected said second electrode to which said scan pulse is applied being thus selected successively, and applying a voltage corresponding to display data to said plurality of third electrodes constituting one display line during a period during which one display line is selected, said voltage applied to said plurality of third electrodes being made different according to a gray-scale level represented by display data; and during a sustaining discharge period, applying a sustaining discharge voltage whose polarity is reversed cyclically between said plurality of pairs of first and second electrodes, the strength of said sustaining discharge voltage being varied.

2. A driving method for a plasma display according to claim 1, wherein the strength of a sustaining discharge voltage is increased gradually during said sustaining discharge period.

3. A driving method for a plasma display according to claim 1, wherein a sustaining discharge voltage is a signal made by synchronizing a plurality of pulses having different strengths.

4. A driving method for a plasma display, wherein the plasma display having a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes; the driving method comprising during an addressing period, applying a scan pulse successively to said plurality of second electrodes, one display line coincident with a selected said second electrode to which said scan pulse is applied being thus selected successively, applying voltages corresponding to display data to said plurality of third electrodes constituting one display line during a period during which one display line is selected, a voltage of said scan pulse applied to a second electrode being varied during said period during which one display line is selected within said addressing period, and the timing of applying a voltage to said plurality of third electrodes being varied according to a gray-scale level represented by display data; and during a sustaining discharge period, applying a sustaining discharge voltage whose polarity is reversed cyclically between said plurality of pairs of first and second electrodes, and the strength of said sustaining discharge voltage being varied.

5. A driving method for a plasma display according to claim 4, wherein said voltage to be applied to a second electrode during said period during which one display line is selected within said addressing period is varied stepwise.

6. A driving method for a plasma display according to claim 4, wherein said voltage to be applied to a second electrode during said period during which one display line is selected within said addressing period is varied continuously.

7. A driving method for a plasma display according to claim 4, wherein the strength of a sustaining discharge voltage is increased gradually during said sustaining discharge period.

8. A driving method for a plasma display according to claim 4, wherein a sustaining discharge voltage is a signal made by synchronizing a plurality of pulses whose strengths are different from one another.

9. A driving method for a plasma display, wherein the plasma display having a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes; the driving method comprising during an addressing period, applying a scan pulse successively to said plurality of second electrodes, one display line coincident with a second electrode to which said scan pulse is applied being thus selected successively, and applying a voltage corresponding to display data to said plurality of third electrodes constituting one display line during a period during which one display line is selected, a voltage to be applied to said first electrodes during said period during which one display line is selected within said addressing period being varied, and the timing of applying a voltage to said plurality of third electrodes being thus varied depending on a gray-scale level represented by display data; and during a sustaining discharge period, applying a sustaining discharge voltage whose polarity is reversed cyclically between said plurality of pairs of first and second electrodes, the strength of said sustaining discharge voltage being varied.

10. A driving method for a plasma display according to claim 9, wherein said voltage to be applied to said first electrodes during said period during which one display line is selected within said addressing period is varied stepwise.

11. A driving method for a plasma display according to claim 9, wherein said voltage to be applied to said first electrodes during said period during which one display line is selected within said addressing period is varied continuously.

12. A driving method for a plasma display according to claim 9, wherein the strength of a sustaining discharge voltage is increased gradually during said sustaining discharge period.

13. A driving method for a plasma display according to claim 9, wherein a sustaining discharge voltage is a signal made by synchronizing a plurality of pulses having different strengths.

14. A plasma display comprising:

a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes;

an address circuit including a Y scan driver for applying a scan pulse successively to said plurality of second electrodes, and an address driver for selecting a voltage to be applied to said plurality of third electrodes from among different voltages according to a gray-scale level represented by display data and applying the selected voltage to said plurality of third electrodes constituting one display line during a period during which one scan pulse is applied to a selected said second electrode; and a sustain driver including an X common driver for applying a voltage, of which the polarity is reversed cyclically, to said plurality of first electrodes, and a Y common driver for applying a voltage, of which the polarity is reversed cyclically, to said plurality of second electrodes.

15. A plasma display comprising:

a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes;

an address circuit including a Y scan driver for successively applying a scan pulse, of which voltage is varied during a period during which one display line is selected, to said plurality of second electrodes, and an address driver for applying a voltage corresponding to display data to said plurality of third electrodes constituting one display line during a period during which one scan pulse is applied to a second electrode at the timing according to a gray-scale level represented by display data; and a sustain driver including an X common driver for applying a voltage, of which the polarity is reversed cyclically, to said plurality of first electrodes, and a Y common driver for applying a voltage, of which the polarity is reversed cyclically, to said plurality of second electrodes.

16. A plasma display comprising:

a plasma display panel including a plurality of pairs of first and second electrodes arranged to be parallel to each other, and a plurality of third electrodes arranged orthogonally to said plurality of pairs of first and second electrodes, a plurality of cells that selectively discharge to glow being defined by said first, second and third electrodes;

an address circuit including a Y scan driver for applying a scan pulse successively to said plurality of second electrodes, an address driver for applying a voltage corresponding to display data to said plurality of third electrodes constituting one display line during a period during which one scan pulse is applied to a second electrode at the timing according to a gray-scale level represented by display data, a level shifting circuit for varying a voltage that is applied to said first electrodes during a period during which one display line is selected, and varying the timing of applying a voltage to said plurality of third electrodes according to a gray-scale level represented by display data; and a sustain driver including an X common driver for applying a voltage, of which the polarity is reversed cyclically, to said plurality of first electrodes, and a Y common driver for applying a voltage, of which the polarity is reversed cyclically, to said plurality of second electrodes.

* * * * *

UNITED STATES PATENT AND TRADEMARK OFFICE

CERTIFICATE OF CORRECTION

PATENT NO. : 5,835,072
DATED : November 10, 1998
INVENTOR(S) : Kanazawa

It is certified that error appears in the above-identified patent and that said Letters Patent is hereby corrected as shown below:

On the title page: Item [56]

Under "[56] References Cited" Other Documents, insert --Nolan, J. F. "A Simple Technique for Obtaining Variable Intensity in AC Plasma Panels", Technical Digest, 1975 International Electron Devices Meeting, Dec.

Column 10, line 57, after "have" insert

--been--

Signed and Sealed this
Seventh Day of December, 1999

*Attest:*

*Attesting Officer*

Q. TODD DICKINSON

*Acting Commissioner of Patents and Trademarks*